United States Patent [19]

Bielfeldt

[11] Patent Number: 5,054,388

[45] Date of Patent: Oct. 8, 1991

[54] CONTINUOUSLY WORKING PRESS

[75] Inventor: Friedrich B. Bielfeldt, Eppingen, Fed. Rep. of Germany

[73] Assignee: Maschinenfabrik J. Dieffenbacher GmbH & Co., Eppingen, Fed. Rep. of Germany

[21] Appl. No.: 519,221

[22] Filed: Apr. 25, 1990

[30] Foreign Application Priority Data

Apr. 25, 1989 [DE] Fed. Rep. of Germany ..... 3913565

[51] Int. Cl.[5] ..... B30B 5/06

[52] U.S. Cl. ..... 100/154; 100/151; 198/831; 425/371

[58] Field of Search ..... 100/93 RP, 151, 152, 100/153, 154; 425/371, 373; 198/626.4, 626.6, 831, 832

[56] References Cited

U.S. PATENT DOCUMENTS

| | | | |
|---|---|---|---|
| 3,120,862 | 2/1964 | Burger | 100/154 |
| 3,910,179 | 10/1975 | Troutner | 425/371 X |
| 3,948,718 | 4/1976 | Mosburger | 100/153 X |
| 4,449,448 | 5/1984 | Stabler et al. | 100/154 X |
| 4,613,293 | 9/1986 | Gerhardt | 425/371 |
| 4,718,843 | 1/1988 | Carlsson et al. | 425/371 |
| 4,748,907 | 6/1988 | Schermutzki | 100/153 |
| 4,923,384 | 5/1990 | Gerhardt | 100/154 X |

FOREIGN PATENT DOCUMENTS

| | | | |
|---|---|---|---|
| 3312856 | 10/1984 | Fed. Rep. of Germany | 425/371 |
| 3743664 | 7/1989 | Fed. Rep. of Germany . | |

*Primary Examiner*—Harvey C. Hornsby
*Assistant Examiner*—Stephen F. Gerrity
*Attorney, Agent, or Firm*—Foley & Lardner

[57] ABSTRACT

A continuous press is provided wherein the elastic forces are conducted centrically from the centering bolts into the vertical Y—Y axis and the longitudinal center of the guide chain. An accumulation of unilateral forces on the brackets of the guide chain is thereby avoided. The elastic forces, which are set up in the bearing bolts by the linear displacements of the rolling bars and are at times considerable, are thus conducted centrically into the guide sleeves and thus as a force centrically into the guide chain. The forces thus do not occur as an eccentric load on the guide chains and, consequently, are incapable of causing the destruction of the guide chains even with a relatively high load.

9 Claims, 6 Drawing Sheets

CONTINUOUSLY WORKING PRESS

BACKGROUND OF THE INVENTION

1. Field of the Invention

The invention relates to a continuously working press for producing chipboard, fiberboard, plywood boards or the like, and more particularly, to a continuously working press wherein individual centering bolts of the chain guide are exchangeable.

2. Discussion of the Related Art

In the continuous press according to German patent 3,743,664 of the same inventor, the guide chain has, in the critical feed curve—and, thus, in the tangential transition into the horizontal press plane—the same circular and secant measure as the rolling bars, because the rolling bars are guided coaxially on a shaft with the same radius "R" via toothed feed wheels and toothed loading wheels. This ensures the orthogonal travel of the rolling bars at an exactly identical distance from the feed curve into the horizontal press plane. Linear displacements, which occur, for example, in the horizontal pressing plane and affect the distance dimension of the guide chain, are absorbed in an elastically compensating manner by centering bolts which are made of spring steel. Compensating play between the centering bolts and guide chains is thus simply and effectively provided.

A disadvantage of this press which has come to light is that if individual centering bolts are damaged or destroyed, the entire guide chain must be dismantled to exchange the bolts. This, naturally, is a time-consuming and costly operation.

A further disadvantage is that the rigid attachment of the centering bolts in the guide chain exerts a great stress on the guide chain and may even destroy the guide chain. Another disadvantageous effect is that the guide chain sometimes bears and rubs against steel strips of the press. The reason for this is that, as a result of the transfer of heat from the heating platens to the press material, thermal stresses arise at the outer edge of the steel strips and result in a wavelike warping of the steel strips. The guide chains and the steel strips are thereby subjected to increased wear.

SUMMARY OF THE INVENTION

Accordingly, an object of the present invention is to provide an improvement for continuous presses wherein individual and specific centering bolts may be exchanged in the press, so that the disadvantages indicated above are avoided.

It is advantageous that faulty or destroyed centering bolts can be exchanged quickly and simply. The shutdown press installation can then be started up again very quickly.

The foregoing and additional objects are attained by providing a continuous press, wherein the elastic forces are conducted centrically from the centering bolts into the vertical Y—Y axis and the longitudinal center of the guide chain. An accumulation of unilateral forces on the brackets of the guide chain is thereby avoided. The elastic forces, which are set up in the bearing bolts by the linear displacements of the rolling bars and are at times considerable, are thus conducted centrically into the guide sleeves and thus as a force centrically into the guide chain. The forces thus do not occur as an eccentric load on the guide chains and, consequently, are incapable of causing the destruction of the guide chains even with a relatively high load.

Further objects and advantages of the invention will become apparent to those skilled in the art from the description and drawings which follow.

DETAILED DESCRIPTION OF THE PREFERRED EMBODIMENTS

Figure 4:
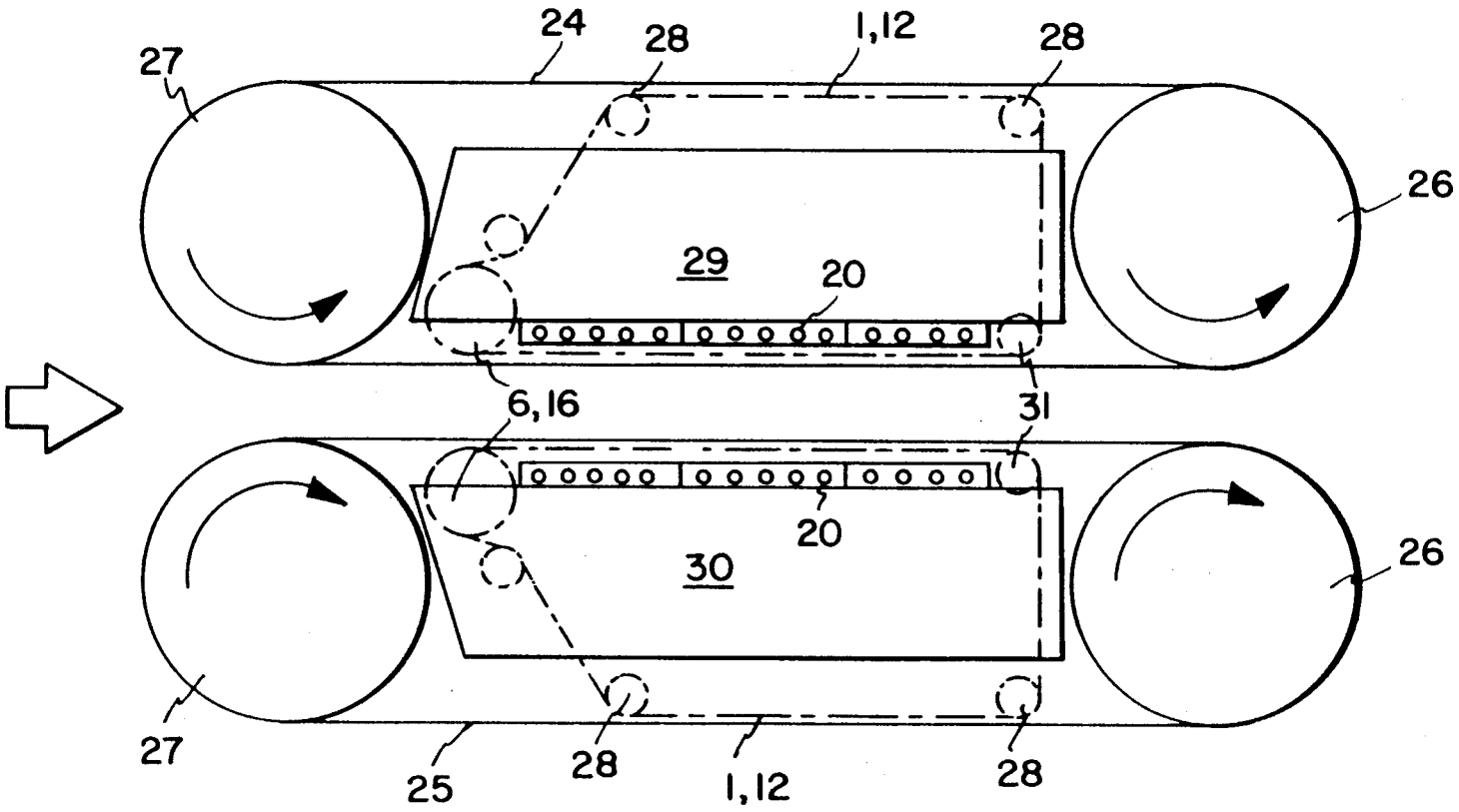
FIG. 4 is a diagrammatic side view of the continuous press according to the present invention.

According to FIG. 4, the continuous press of the present invention comprehends a press table 30 and a movable press ram 29, which are connected by tension pillars (not shown). In order to adjust the press gap between the press ram 29 and the press table 30, the press ram 29 is moved up and down by hydraulic piston-cylinder arrangements (not shown) and halted at a desired point. Steel strips or bands 24 and 25 are each guided via a drive roller 26 and deflection roller 27 around press table 30 and press ram 29. In order to reduce friction between the heating platens 20, attached to the press table 30 and press ram 29, and the circulating steel strips 24 and 25, a carpet of rolling bars, which also circulate and are formed from rolling bars 1, is provided for each of the table 30 and ram 29. The rolling bars 1, the axes of which extend transverse to the direction of travel (indicated by an arrow in FIG. 4) of the strip, are connected together on both longitudinal sides of the press by guide sleeves 9 of the guide chain 12 with a predetermined pitch and, rolling against the heating platens 20 of press ram 29 and press table 30 on one side and against the steel strips 24 and 25 on the other side, are drawn by the steel strips 24, 25 through the press.

Figure 1:
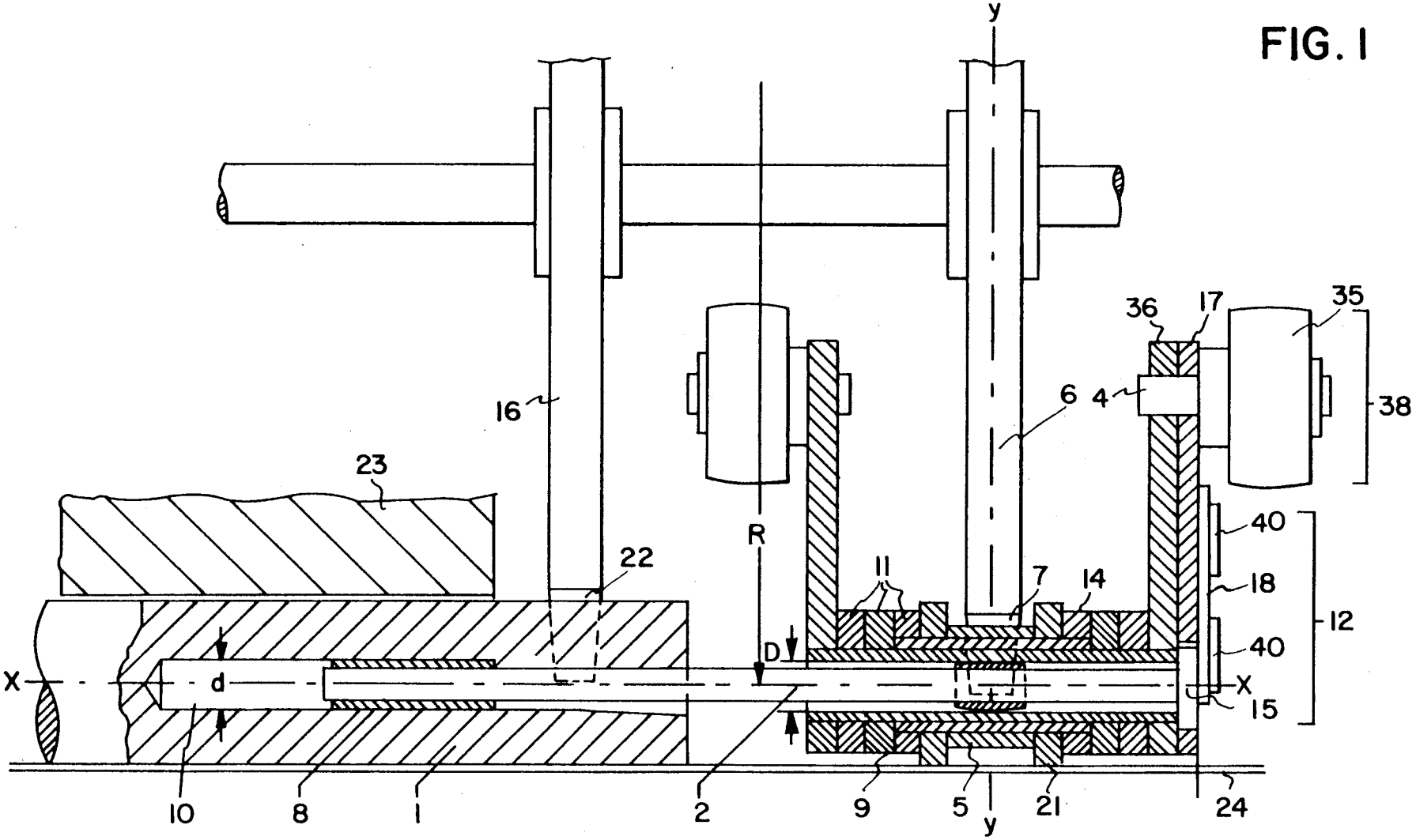
FIG. 1 is a partial front section of the guide chain with a rolling bar.

In each circulating carpet of rolling bars of press ram 29 and press table 30, the rolling bars 1 are force-guided by a plurality of toothed loading wheels 16. The guide chains 12 are guided by two toothed feed wheels 6 arranged laterally of a respective feed heating platen 23 (FIG. 1). The rolling bars 1 and guide chains 12 are guided with an identical circular and secant measure in the feed curve and in the tangential transition into the horizontal press plane. The toothed loading wheels 16 and the toothed feed wheels 6 are arranged on an axis X—X (FIG. 1). The centrical distance of the rolling bars 1 and the guide chain 12 is at all times identical to the unwinding radius "R" of the toothed loading wheels 16 and of the toothed feed wheels 6 and will not vary in the transitional tangent into the horizontal press plane. It is thus possible to control the rolling bars 1 completely and exactly in the feed curve and, consequently, to align the rolling bars 1 precisely and orthogonally until the compression zone is reached.

Figure 2:
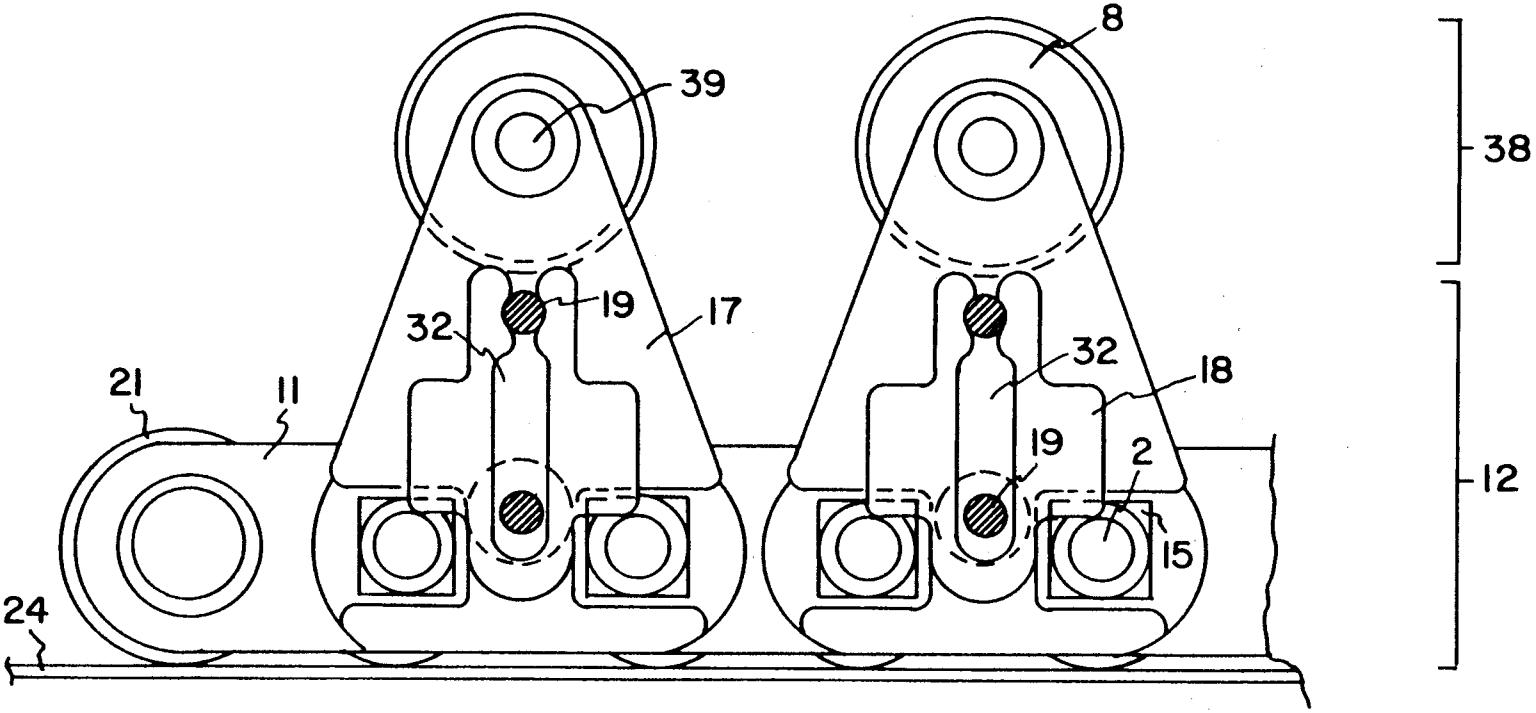
FIG. 2 is a side view of the guide chain corresponding to FIG. 1 in the pressing zone.
Figure 3:
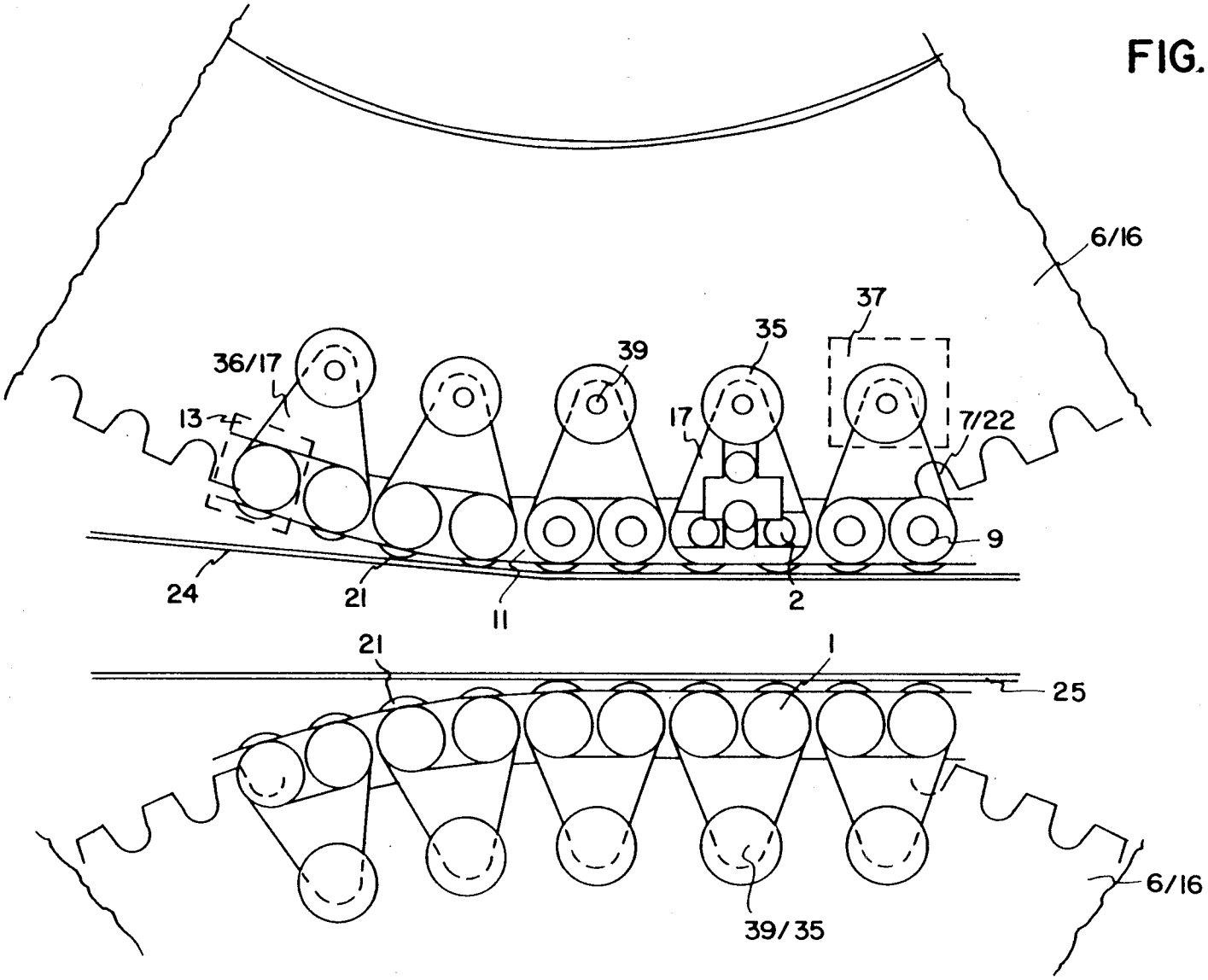
FIG. 3 is a side view of the portion of the continuous press wherein the rolling bars are introduced into the feed curve.

Referring now to FIG. 1, when the press is idle, i.e. when the steel strip 24 is slack as a drive element in the upper half of the continuous press, the guide chain 12 is supported in a rolling manner by suspension brackets 36 via running rollers 35 in guide rails. An articulation 37 (FIG. 3) of support chain 38 is thereby formed by suspension brackets 36 and chain bolts 39 (FIG. 2). The design of the guide chain 12 and of the tangential transition from the feed curve into the horizontal press plane is illustrated in FIG. 3. It can also be seen from FIGS. 1–3, 5 and 6 that overdrive rollers 5 are guided by recesses 7 in the toothed feed wheels 6, and the rolling bars 1 are guided by recesses 22 in the toothed loading wheels 16. The circulation of the rolling bars via the deflecting wheels 28 and 31 is shown in FIG. 4.

As illustrated in FIGS. 1, 2, 5 and 6, the forces exerted by the rolling bars 1 will be conducted centrically via resilient centering bolts 2 in guide sleeves 9 of a guide chain 12, which is designed as a hollow chain. To this end, the elastic forces of the centering bolts 2 are absorbed via spherical bearing sleeves 14 centrically via the guide sleeves 9 of the guide chain 12, while the centering bolts 2 are mounted rotatably at the other end by means of rotation sleeves 8 in bores 10 of the rolling bars 1. This allows the elastic forces to be conducted centrically from the centering bolts 2 into the vertical axis Y—Y and the longitudinal center of the guide chain 12. The design of the centering bolts 2 and of the guide chain 12 for a rapid exchange of the centering bolts is clear from FIGS. 1, 2, 5 and 6 and will be further explained below.

In order for the centering bolts 2 to be arranged in the guide chain 12 in a torsion-free and exchangeable manner, the centering bolts 2 are provided at their outer ends with square press-fit sleeves 15. As a fastening for the square press-fit sleeves 15, stop plates 17 are fastened to enlarged outer brackets 3 (FIG. 5) and 36 (FIG. 1), respectively, in such a way that the lower edge of stop plates 17 bears against the square press-fit sleeves 15 and thus secures them free from torsion. The centering bolts 2, consequently, are also secured torsion-free. In order to protect the centering bolts 2 from displacement and to align them, two clamping bolts 19 (FIG. 2), against which spring steel locking plates 18 are detachably clamped by means of clamping slot 32, are fastened in the outer brackets 3 and 36, respectively, and the stop plates 17.

These designs of the centering bolt 2 and the guide chains 12 ensure that the rolling bars 1 roll with their bore 10 about the fixed centering bolt 2. The centering bolt 2 can be freed by pushing up the locking plate 18. Since the bore diameter D of the guide sleeve 9 is somewhat greater than the bore diameter d in the rolling bar 1, the centering bolt 2 can easily be withdrawn. A washer 40 (FIGS. 1 and 5) prevents the locking plate 18 from becoming detached from the clamping bolts 19.

Undulations, caused by thermal stresses, typically occur at the outer longitudinal edges of the steel strips 24 and 25. The brackets 3 and 11 of the guide chain 12 may rub against these undulations and become prematurely worn. Traveling rollers 21, provided on the articulation sleeves 9 of the guide chains 12 and having an identical diameter to the rolling bars 1, are intended to prevent this premature wear. The guide chain 12 is consequently supported in a reliable, rolling manner on the steel strip 24 or 25 by virtue of the traveling rollers 21.

Figure 5:
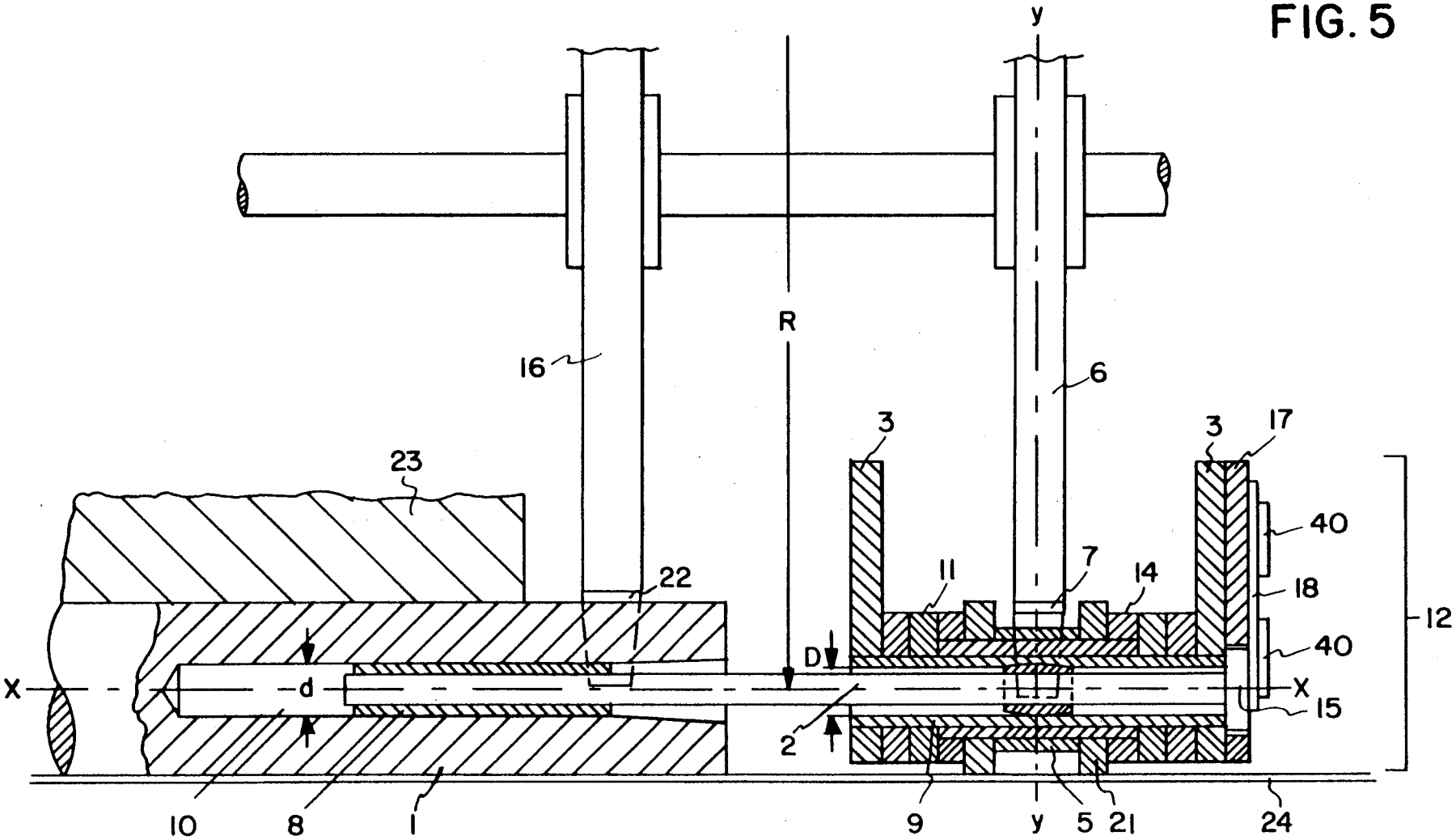
FIGS. 5 and 6 show a second embodiment of the hollow chain corresponding to FIGS. 1 and 2.
Figure 6:
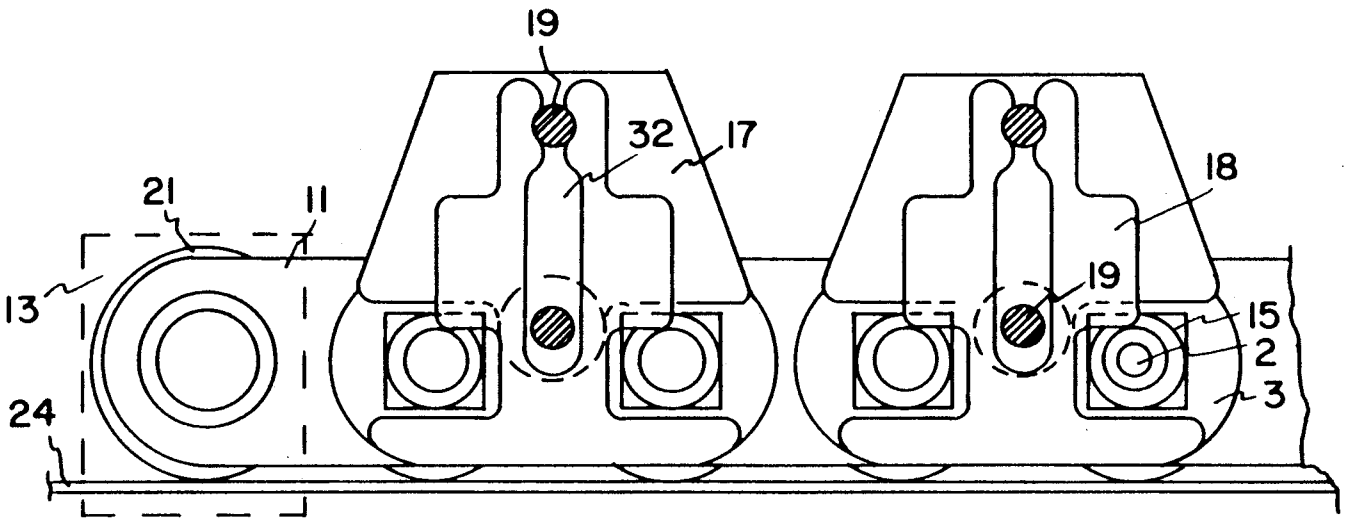

A simplified embodiment of the hollow chain is shown in FIGS. 5 and 6. The support chain 38, together with the running rollers 35, the suspension brackets 36, the chain bolts 39, and the articulation 37, have here been omitted.

The design of the guide chain 12 and of the tangential transition from the feed curve into the horizontal press plane is illustrated in FIG. 3.

It will become obvious to those skilled in the art that the present invention is not limited to the preferred embodiments shown and described.

What is claimed is:

1. A continuously working press, comprising:

a table member;

a press member disposed thereover defining a horizontal pressing plane therebetween;

first and second flexible bands disposed about said table member and press member, respectively;

means for rotating said bands about said table member and press member, respectively;

a roller rod assembly disposed between each of said table member and said first flexible band and said press member and said second flexible band, respectively;

each of said roller rod assemblies comprising:

1) a plurality of roller rods extending transversely of the direction of rotation of said flexible bands;

2) a guide chain assembly, including a guide chain, connected to said roller rods and extending beyond the pressing plane, said guide chain having one guide sleeve defining a guide chain bore for connection with each roller rod, each said guide sleeve including a spherical bearing sleeve disposed in said guide chain bore at a transverse central portion thereof;

3) means for force-guiding said roller rods and said guide chain assembly onto said horizontal pressing plane with the same arc and secant dimensions as the path of said roller rods; and 4) a centering bolt provided at each end of each roller rod, each said centering bolt having a first end rotatably disposed in a roller rod bore of said roller rod and having a second end rotatably and centrally disposed in said guide chain bore and in said spherical bearing sleeve of a respective one of said guide sleeves.

2. The continuously working press as claimed in claim 1, wherein each said roller rod assembly further comprises a square press-fit sleeve provided for each said guide sleeve to secure said second end of said centering bolt.

3. The continuously working press as claimed in claim 2, wherein the diameter of said guide chain bore is larger than the diameter of said roller rod bore.

4. The continuously working press as claimed in claim 3, wherein a locking plate made from spring steel, provided with a clamping slot and locking said centering bolts in said guide sleeves, is attached to said clamping bolts so as to be capable of being moved up and down.

5. The continuously working press as claimed in claim 3, wherein said centering bolts are provided with rotation sleeves with which they are rotatably mounted in said roller rod bores.

6. A continuously working press, comprising:

a table member;

a press member disposed thereover defining a horizontal pressing plane therebetween;

first and second flexible bands disposed about said table member and press member, respectively;

means for rotating said bands about said table member and press member, respectively;

a roller rod assembly disposed between each of said table member and said first flexible band and said press member and said second flexible band, respectively;

each of said roller rod assemblies comprising:

1) a plurality of roller rods extending transversely of the direction of rotation of said flexible bands;

2) a guide chain assembly, including a guide chain, connected to said roller rods and extending beyond the pressing plane, said guide chain having one guide sleeve defining a guide chain bore for connection with each roller rod, each said guide sleeve including a spherical bearing sleeve disposed in said guide chain bore at a transverse central portion thereof, 3) means for force-guiding said roller rods and said guide chain assembly onto said horizontal pressing plane with the same arc and secant dimensions as the path of said roller rods, 4) a centering bolt provided at each end of each roller rod, each said centering bolt having a first end rotatably disposed in a roller rod bore of said roller rod and having a second end rotatably and centrally disposed in said guide chain bore and in said spherical bearing sleeve of a respective one of said guide sleeves, said guide chain bore being larger in diameter than said roller rod bore, and 5) a square press-fit sleeve provided for each said guide sleeve to secure said second end of said centering bolt;

said guide chain assembly further comprising outer brackets for a support chain extending from said guide chain and stop plates fastened to the outer brackets so that the lower edges of said brackets bear against a side of said square press-fit sleeves.

7. The continuously working press as claimed in claim 6, wherein two clamping bolts are fastened in the stop plates.

8. A continuously working press, comprising:

a table member;

a press member disposed thereover defining a horizontal pressing plane therebetween;

first and second flexible bands disposed about said table member and press member, respectively;

means for rotating said bands about said table member and press member, respectively; and a roller rod assembly disposed between each of said table member and said first flexible band and said press member and said second flexible band, respectively;

each of said roller rod assemblies comprising:

1) a plurality of roller rods extending transversely of the direction of rotation of said flexible bands;

2) a guide chain assembly, including a guide chain, connected to said roller rods and extending beyond the pressing plane, said guide chain having one guide sleeve defining a guide chain bore for connection with each roller rod, each said guide sleeve including a spherical bearing sleeve disposed in said guide chain bore at a transverse central portion thereof, 3) means for force-guiding said roller rods and said guide chain assembly onto said horizontal pressing plane with the same arc and secant dimensions as the path of said roller rods, 4) a centering bolt provided at each end of each roller rod, each said centering bolt having a first end rotatably disposed in a roller rod bore of said roller rod and having a second end rotatably and centrally disposed in said guide chain bore and in said spherical bearing sleeve of a respective one of said guide sleeves, said guide chain bore being larger in diameter than said roller rod bore, and 5) a square press-fit sleeve provided for each said guide sleeve to secure said second end of said centering bolt; and travelling rollers which are attached to said guide sleeves for supporting said guide chain.

9. The continuously working press as claimed in claim 8, wherein said travelling rollers have a diameter which is identical to the diameter of the roller rods.

* * * * *